US005318225A

United States Patent [19]

Condron

[11] Patent Number: 5,318,225

[45] Date of Patent: Jun. 7, 1994

[54] METHODS AND APPARATUS FOR PREPARING MIXTURES WITH COMPRESSED FLUIDS

[75] Inventor: James A. Condron, Hurricane, W. Va.

[73] Assignee: Union Carbide Chemicals & Plastics Technology Corporation, Danbury, Conn.

[21] Appl. No.: 952,609

[22] Filed: Sep. 28, 1992

[51] Int. Cl.[5] ..... B05B 7/16

[52] U.S. Cl. ..... 239/1; 239/8; 239/135; 239/322; 366/177

[58] Field of Search ..... 239/1, 8, 61, 75, 135, 239/302, 303, 304, 307, 308, 320, 321, 322; 366/152, 160, 161, 162, 177; 222/145, 133, 129.2, 1

[56] References Cited

U.S. PATENT DOCUMENTS

| | | | |
|---|---|---|---|
| 1,574,183 | 2/1926 | Bodfish | 239/322 |
| 1,578,944 | 3/1926 | Wilkinson | 239/322 |
| 4,278,205 | 7/1981 | Binoche | 239/75 |
| 4,515,310 | 5/1985 | Hengesbach | 239/8 |
| 4,582,731 | 4/1986 | Smith | 427/421 |
| 4,621,927 | 11/1986 | Hiroi | 366/132 |
| 4,734,227 | 3/1988 | Smith | 264/13 |
| 4,734,451 | 3/1988 | Smith | 524/493 |
| 4,882,107 | 11/1989 | Cavender et al. | 264/51 |
| 4,923,720 | 5/1990 | Lee et al. | 427/422 |
| 5,009,367 | 4/1991 | Nielsen | 239/3 |
| 5,057,342 | 10/1991 | Hoy et al. | 427/422 |
| 5,098,194 | 3/1992 | Kuo et al. | 366/152 |
| 5,203,504 | 4/1993 | Frost et al. | 239/322 |

FOREIGN PATENT DOCUMENTS 1322237 7/1987 U.S.S.R. .

*Primary Examiner*—Andres Kashnikow
*Assistant Examiner*—Karen B. Merritt
*Attorney, Agent, or Firm*—G. L. Coon

[57] ABSTRACT

Methods and apparatus are disclosed for forming a liquid spray mixture containing accurately proportionated amounts of viscous coating concentrate and compressed fluid diluent such as carbon dioxide. The proportionation is accomplished by passing the fluid diluent through two sets of flow restrictors under the same pressure drops to form two proportioned flows of diluent. One diluent flow is converted by volumetric displacement to an equal flow of liquid concentrate, which is mixed with the other diluent flow to form the liquid spray mixture.

17 Claims, 4 Drawing Sheets

METHODS AND APPARATUS FOR PREPARING MIXTURES WITH COMPRESSED FLUIDS

RELATED PATENTS

This application contains subject matter related to U.S. Pat. No. 4,923,720, issued May 8, 1992 and U.S. Pat. No. 5,108,799, issued Apr. 28, 1992.

FIELD OF THE INVENTION

This invention, in its broadest embodiment, pertains to the field of effectively proportionating a liquid concentrate and a fluid diluent having significantly different physical properties, such as viscosity, density, compressibility, and vapor pressure, to form a desired liquid mixture. More specifically, the present invention, in its more preferred embodiments, is directed to methods and apparatus for forming a liquid spray mixture containing an accurately proportionated amount of compressed fluid as a viscosity reduction diluent. The resultant properly proportioned liquid mixture can then be sprayed, such as to deposit a coating onto a substrate.

DESCRIPTION OF THE PRIOR ART

In coating and other spray applications, it is often necessary to prepare a spray mixture as it is sprayed, by continually blending two or more fluid components in the proper proportions and then supplying them to the spray tip in a spray gun well mixed and at the proper temperature and pressure. obtaining and maintaining the proper composition and spray conditions are essential to achieving proper spray performance.

Conventional systems use two basic methods to achieve these conditions: (1) the inlet flow rates of both components are metered in some manner and adjusted to give the desired proportion; or (2) a characteristic property of the blended mixture is measured to derive an error/correction signal and then one or both inlet flow rates are adjusted to minimize error. These control methods are known respectively as feed forward and feedback control strategies to those skilled in the art.

Simple proportioning systems are commercially available which meter each component stream across a restriction device (typically an adjustable needle valve). These restriction devices are often incorporated into the spray gun assembly itself, thereby attaining a very inexpensive proportioning system. However, these simple systems tend to have unsatisfactory proportioning accuracy and reliability for many applications, particularly when one of the component streams has high viscosity. These systems are therefore generally impractical within the field of the present invention.

It is, therefore, of particular interest to provide a proportionation method and apparatus that is comparatively simple and inexpensive, but which has much better accuracy and reliability than conventional prior art methods and apparatus.

SUMMARY OF THE INVENTION

In its broad aspect, the present invention achieves the above objectives by providing a proportionating method and apparatus that are capable of accurately proportioning a liquid concentrate, such as a viscous coating concentrate or similar liquids, with a low viscosity fluid diluent, such as a compressed fluid, such as carbon dioxide, by utilizing the simplicity of flow restrictors, but which avoids the use of restrictors to regulate absolute flow rate.

More specifically, the present invention in its broader embodiment comprises a method for forming a liquid mixture of liquid concentrate and fluid diluent in fixed proportion, which comprises:

(a) providing a first flow of diluent with flow rate $F_D$ and a second flow of diluent with flow rate $F_C$, by supplying diluent at substantially equal and constant pressures and temperatures to a first flow restrictor means and a second flow restrictor means in parallel, each flow restrictor means containing at least one flow restrictor and having the flow restrictors dimensionally sized and configured to produce, in combination, a fixed flow rate proportion of first flow of diluent to second flow of diluent of $F_D/F_C$, which is substantially equivalent to the desired proportion of fluid diluent to liquid concentrate in said liquid mixture, for substantially equal pressure drops across the flow restrictor means;

(b) volumetrically converting said second flow of diluent from said second flow restrictor means into a flow of concentrate having substantially the same flow rate and substantially the same pressure, by using a volumetric flow conversion means comprising a housing having a diluent chamber and a concentrate chamber separated by a freely moving partition and being configured such that flow of said second flow of diluent into the diluent chamber simultaneously and volumetrically displaces the partition and thereby causes concentrate to flow from the concentrate chamber at a flow rate substantially the same as flow rate $F_C$, the concentrate chamber being filled with concentrate prior to proportionation; and (c) mixing said flow of concentrate from said concentrate chamber and said first flow of diluent from said first flow restrictor means at substantially the same pressures to form a liquid mixture.

The components are arranged so that process and fluid variables that govern the flow rates through the flow restrictor means, such as pressure drop, viscosity, and density, remain in dynamic balance across both flow restrictor means. Therefore, although the absolute flow rates may vary, the resulting proportionation, which is determined by the flow rate ratios between the flow restrictor means, is essentially invariant. A volumetric flow conversion means is utilized to simultaneously convert one proportioned flow of fluid diluent into a proportioned flow of liquid concentrate. The proportioned flow of liquid concentrate is then mixed with the other proportioned flow of fluid diluent to produce the liquid mixture. In a preferred embodiment, the liquid concentrate is a viscous coating concentrate, the fluid diluent is a compressed fluid, and the accurately proportioned liquid mixture is a liquid spray mixture, such as for spray applying a coating to a substrate. The preferred compressed fluid is carbon dioxide.

The present invention also comprises an apparatus for forming a liquid mixture of liquid concentrate and fluid diluent in fixed proportion, which comprises:

(a) means for providing a first flow of diluent with flow rate $F_D$ and a second flow of diluent with flow rate $F_C$, which comprises a first flow restrictor means and a second flow restrictor means operating in parallel, each flow restrictor means containing at least one flow restrictor and having the flow restrictors dimensionally sized and configured to produce, in combination, a fixed flow rate proportion of first flow of diluent to second flow of diluent of $F_D/F_C$, which is substantially equivalent to the desired proportion of fluid diluent to liquid concentrate in said liquid mixture, for substantially equal pressure drops across the flow restrictor means;

(b) means for supplying diluent at substantially equal and constant pressures and temperatures to said first and second flow restrictor means;

(c) means for volumetrically converting said second flow of diluent from said second flow resistor means into a flow of concentrate having substantially the same flow rate and substantially the same pressure, which comprises a housing having a diluent chamber and a concentrate chamber separated by a freely moving partition and being configured such that flow of said second flow of diluent into the diluent chamber simultaneously and volumetrically displaces the partition and thereby causes concentrate to flow from the concentrate chamber at a flow rate substantially the same as flow rate $F_C$;

(d) means for filling said concentrate chamber with concentrate prior to proportionation; and (e) means for mixing said flow of concentrate from said concentrate chamber and said first flow of diluent from said first flow restrictor means at substantially the same pressures to form a liquid mixture.

BRIEF DESCRIPTION OF THE DRAWINGS

These and other features and a fuller understanding of the invention will be had by referring to the following description and drawings herein.

DETAILED DESCRIPTION OF THE INVENTION

The invention provides methods and apparatus for producing a liquid mixture having a constant proportion of liquid concentrate and fluid diluent, such as to produce a liquid spray mixture for spraying. The absolute flow rates of concentrate and diluent may vary in accordance with how the liquid mixture is Utilized in any given application, but the proportion of diluent flow rate to concentrate flow rate is accurately maintained independently of the absolute flow rates. This is accomplished by passing only the fluid diluent, which has relatively low viscosity, through two flow restrictor means in parallel under equal operating conditions, to obtain two proportioned flow rates, instead of passing the fluid diluent and the viscous liquid concentrate each through a flow restrictor means. Therefore, the diluent can pass through both flow restrictor means at nearly equal values of differential pressure, temperature, density, and viscosity. Although the type of flow restrictor means, including the arrangement of its constituent flow restrictors if more than one flow restrictor is utilized, is not narrowly critical to the practice of the present invention, the relative overall flow resistance levels of the two flow restrictor means, as determined by the configuration and relative dimensional sizes of the flow restrictors, determines the proportion of diluent ultimately mixed with the concentrate.

Figure 1:
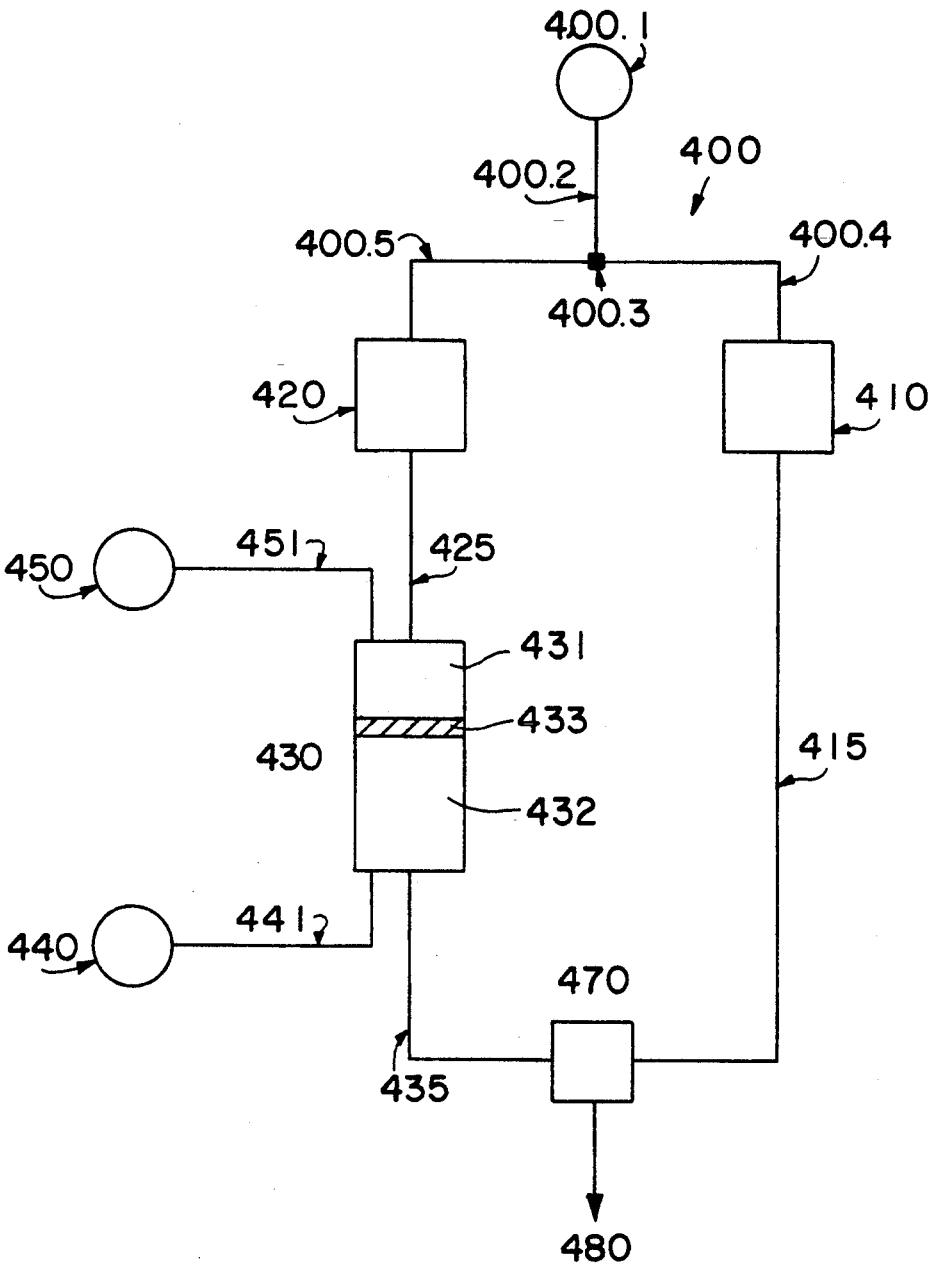
FIG. 1 is a schematic drawing of a broader embodiment of the present invention showing the basic elements of the method and apparatus used to prepare a proportioned liquid mixture of liquid concentrate and fluid diluent.

Referring to FIG. 1, which shows a schematic diagram of the present invention in its most basic form, a fluid diluent, which is to be proportionately mixed with a liquid concentrate to form a desired liquid mixture, is supplied from a diluent supply means, denoted generally as 400 in the drawing which comprises elements 400.1, 400.2, 400.3, 400.4 and 400.5 described furter herein below, at substantially equal and constant pressures and temperatures to a first flow restrictor means 410 and a second flow restrictor means 420 that operate with parallel flow of diluent. The diluent supply means 400 may be any suitable supply source and flow distribution means. The supply source, denoted as 400.1, may be a cylinder or a tank with a pump to pressurize the diluent and a pressure regulator to adjust the pressure and maintain constant pressure. The flow distribution means may comprise a supply conduit 400.2, a flow splitter 400.3, and distribution conduits 400.4 and 400.5. The flow distribution means may also contain suitable flow valves (not shown). The flow splitter and flow conduits preferably are dimensionally sized to have very little flow resistance compared to the flow resistances of the flow restrictor means. The distribution conduits preferably have substantially the same flow resistances.

The first flow restrictor means 410 produces a first flow of diluent 415 for mixing with the concentrate. The second flow restrictor means 420 produces a second flow of diluent 425 that is equivalent to the desired proportioned flow of concentrate. The flow restrictor means 410 and 420 each contain at least one flow restrictor through which the diluent flows. A flow restrictor is a device well known to those having ordinary skill in the art of process control. A flow restrictor can be as simple as an orifice or a hole in solid plate, but preferably the flow restrictor is a tube of given inside diameter and length, such as a capillary tube. Typically the inside diameter is significantly smaller than the diameter of the flow conduits and the restrictor has a high ratio of length to diameter. By varying the length and diameter of the tubular restrictor, that is, the dimensional size, the resistance to flow through the restrictor can be varied, and hence the flow rate of diluent passing through the restrictor can be varied and adjusted for constant pressure drop. If desired, the flow restrictor means may consist of two or more flow restrictors in combination to obtain the desired overall and relative flow resistance level and to have the capability of adjusting the resistance level. The flow restrictors used in combination may have different diameters and lengths, that is, different flow resistance levels, and they may be combined to form A flow resistor network containing resistors in parallel and/or series, as is known to those skilled in the art of fluid mechanics. The possible types and dimensional sizes of flow restrictors and restrictor networks are very numerous and dimensional sizing procedures for the more common restrictors such as tubes and orifices are readily available in the prior art. The restrictors may be designed to operate in laminar or turbulent flow regimes. See, for example, "Flow of Fluids Through Valves, Fittings, and Pipe", Technical Paper No. 410, Crane Company, N.Y., 1985. The overall flow resistance levels of the first flow restrictor means 410 and the second flow restrictor means 420 are adjusted to give the desired proportion of diluent flow rates through the flow restrictor means and to give a suitable total flow rate range for the given application. By subjecting each flow through the flow restrictor means to essentially identical process conditions, the flow rates maintain the proper proportion while the overall flow rates are permitted to vary. The flow rate proportion is changed by changing the flow restrictors used.

The second diluent flow 425 is converted to a concentrate flow 435 having substantially the same flow rate and substantially the same pressure by using a volumetric flow conversion means, denoted as 430 in the drawing. The volumetric flow conversion means is any suitable device comprising a housing having a diluent chamber 431 and a concentrate chamber 432 separated by a freely moving partition 433. The chambers and partition are configured such that flow of the proportioned second diluent flow 425 into diluent chamber 431 simultaneously and volumetrically displaces partition 433, which thereby displaces concentrate from concentrate chamber 432, by virtue of having reduced the chamber volume, to form concentrate flow 435 having substantially the same volumetric flow rate as diluent flow 425. The partition may be any suitable freely moving diaphragm or piston or other device, which is preferably sealed to prevent flow across or around the partition. The partition exchanges volume between the diluent chamber and concentrate chamber as it travels within the housing. Preferably the partition and chambers are configured to maximize total volume exchanged between the chambers as the partition travels, in order to maximize flow capacity. The freely moving partition preferably requires little pressure drop across the partition, preferably negligible fluctuations in system pressure, to travel within the housing, thereby minimizing pressure drop across the volumetric flow conversion means to give essentially the same exit pressures from the two flow restrictor means. The preferred freely moving partition is a piston-type partition in a cylindrical housing, which is similar in form, but not in function, to commercial devices known as accumulators. Preferably the piston-type partition is a spool-shaped piston having a captive solvent lubricant in the annular volume between the seals to reduce friction and improve seal lifetime. The housing is typically a suitable pressure vessel. While the preferred form of volumetric flow conversion means has been described, it should be apparent to those skilled in the art that other flow conversion means may be employed that are different from those shown without departing from the spirit and scope thereof. For example, the diluent chamber and concentrate chamber may be contained within separate housings, each of which has a partition such that the two partitions are mechanically coupled so that motion of one produces motion of the other.

Prior to starting proportionation, the concentrate chamber 432 is filled with concentrate from concentrate supply means 440, through supply conduit 441, and the diluent chamber is preferably substantially empty, that is, the partition is initially positioned to give minimal diluent volume in the diluent chamber and maximum concentrate volume in the concentrate chamber. The concentrate supply means 440 may be any suitable source, such as a tank and an air driven supply pump operating at a suitable supply pressure. The supply pressure is set so that the supply pump stalls when the concentrate chamber is filled and is typically incrementally above the operating pressure of the concentrate chamber. After the concentrate chamber is filled, the supply conduit 441 is closed by a suitable flow valve (not shown).

Proportionation can continue until displacement of the partition ceases to displace concentrate from the concentrate chamber, at which point the proportionation is stopped. The concentrate chamber is then refilled with concentrate and the accumulated diluent is removed from the diluent chamber through conduit 451 to diluent collection means 450, by using suitable flow valves (not shown). Preferably, the diluent is recycled for reuse, in which case the diluent collection means may be the diluent supply source 400.1. After the concentrate chamber is refilled, the proportionation cycle may be repeated.

During proportionation, because the partition separating the two chambers moves freely, the concentrate flows from the concentrate chamber at substantially the same pressure as the diluent flowing into the diluent chamber. Therefore, the concentrate flow 435 and the first flow of diluent 415 are blended and mixed at substantially equal pressures in mixing means 470 to form the desired flow of proportioned liquid mixture 480 to the given application, such as a spray application.

As used herein, a liquid concentrate is any liquid material that is desired to be diluted with a fluid diluent for some purpose, such as to reduce its viscosity for some application. Although the methods and apparatus of the present invention may be used with liquid concentrates that have relatively low viscosity prior to being mixed with the fluid diluent, the greatest utility is derived for liquid concentrates having relatively high viscosity, for which conventional flow restrictor proportioning methods are inadequate. One particularly useful application is the preparation of liquid mixtures for spray applications, such as coating substrates with coating materials.

Typically, liquid concentrates for coating applications include a solids fraction containing at least one component that is capable of forming a coating on a substrate, whether such component is a paint, lacquer, varnish, adhesive, mold release agent, chemical agent, lubricant, protective oil, non-aqueous detergent, or the like, including fertilizers, herbicides, pesticides, and other materials utilized in the agricultural field. Typically, at least one component is a polymer component, which is well known to those skilled in the coatings art.

In particular, suitable polymeric components include vinyl, acrylic, and styrenic polymers and interpolymers; polyesters, alkyds, polyurethanes, epoxy systems, phenolic systems, cellulosic polymers, amino resins, silicone polymers, rubbers, natural gums and resins, and the like.

In addition to the polymeric component, the solids fraction may contain conventional additives that are utilized in coatings. These include, but are not limited to, pigments, metallic flakes, fillers, cross-linking agents, anti-foam agents, wetting agents, and the like, and mixtures thereof.

The solids fraction is typically dissolved and/or suspended in a solvent fraction. Suitable organic solvents include, but are not limited to, ketones, esters, ethers, glycol ethers, glycol ether esters, alcohols, aromatic hydrocarbons, aliphatic hydrocarbons, and mixtures thereof. Generally, solvents suitable for coating applications must have the desired solvency characteristics and the proper balance of evaporation rates so as to insure good coating formation, as is known to those skilled in the coatings art.

The present invention is particularly suitable for use with liquid coating concentrates that have minimal organic solvent content in order to minimize solvent emissions that cause air pollution in spray operations. As disclosed in the aforementioned related U.S. Pat. No. 4,923,720, the viscous liquid concentrates are typically mixed with a proportioned amount of environmentally compatible supercritical fluid, such as supercritical carbon dioxide, to form a liquid spray mixture having low viscosity that is suitable for spraying.

As used herein, a fluid diluent is any liquid, gaseous, or supercritical fluid having a relatively low viscosity that is suitable for being mixed with a liquid concentrate in a proportioned amount to dilute the liquid concentrate to a level suitable for a given application. Preferably, the fluid diluent has appreciable solubility in the liquid concentrate. Therefore the fluid diluent may be a suitable conventional liquid solvent, such as an organic solvent or an aqueous solvent, but the preferred fluid diluent for use with the present invention is a compressed fluid.

As used herein, it will be understood that a "compressed fluid" is a fluid which may be in its gaseous state, its liquid state, or a combination thereof, or is a supercritical fluid, depending upon the particular temperature and pressure to which it is subjected, the vapor pressure of the fluid at that particular temperature, and the critical temperature and critical pressure of the fluid, but which is in its gaseous state at standard conditions of 0° Celsius temperature and one atmosphere absolute pressure (STP).

As used herein, a "supercritical fluid" is a material that is at a temperature and pressure such that it is at, above, or slightly below its "critical point". As used herein, the "critical point" is the transition point at which the liquid and gaseous states of a substance merge into each other and represents the combination of the critical temperature and critical pressure for a given substance. The "critical temperature", as used herein, is defined as the temperature above which a gas cannot be liquefied by an increase in pressure. The "critical pressure", as used herein, is defined as that pressure which is just sufficient to cause the appearance of two phases at the critical temperature.

Compressed fluids that may be used as fluid diluents in the present invention include, but are not limited to, carbon dioxide, nitrous oxide, ammonia, xenon, ethane, ethylene, propane, propylene, butane, isobutane, chlorotrifluoromethane, monofluoromethane, and mixtures thereof. Due to environmental compatibility and relatively low cost, the preferred compressed fluid diluents are carbon dioxide, nitrous oxide, and ethane. Carbon dioxide is the most preferred compressed fluid diluent because it has low cost, is readily available in bulk quantity, has favorable solubility characteristics, has low toxicity, and is stable and nonflammable.

One objective in the present invention is to obtain as nearly equal differential pressures across the flow restrictor means as is reasonably possible. The main factors which can cause inequality are mechanical friction in the moving partition and fluid friction resulting from flow of a viscous liquid concentrate through conduit 435 and associated valves (not shown) before it is diluted with fluid diluent in mixing means 470. To whatever extent these factors are constant, one method of balancing the pressure inequality is to install a suitable spring-loaded check valve in fluid diluent conduit 415, such that the pressure drop across the check valve, that is required to open it, is equal to the pressure drop in the flow of liquid concentrate caused by frictional effects. Other methods, such as a differential pressure regulator, may also be used. The flow resistance level of the first flow restrictor means might also be increased by an incremental amount, or a small auxiliary flow restrictor added, to compensate for any pressure imbalance.

The amount of pressure differential caused by frictional effects depends upon the specific equipment design and dimensions. Designs that minimize flow frictional effects are preferred, such as avoiding using concentrate flow conduits that have an overly small flow diameter and are overly long in length. Concentrate flow conduits that have relatively large flow diameter and are relatively short are preferred. Therefore, the mixing means 470 is preferably located close to the concentrate chamber 432.

To minimize flow frictional effects, the liquid concentrate should not have an excessively high viscosity. Preferably, the liquid concentrate has a viscosity below about 5,000 centipoise. More preferably, the liquid concentrate has a viscosity below about 3,000 centipoise. Most preferably, the liquid concentrate has a viscosity below about 2,000 centipoise.

In order to minimize the impact of pressure imbalance due to frictional effects, preferably a relatively high differential pressure, nominally 50 to 500 psi, is established across the flow restrictor means. That is, the pressure drop across the flow restrictor means should be much larger than the pressure drop due to frictional effects so that the differential pressures are substantially the same.

When flow of liquid mixture 480 is stopped, such as when a spray gun is turned off, all fluid pressures equalize to the supply pressure of the fluid diluent, because flow does not occur across the flow restrictor means. Therefore, when flow is started, such as when the spray gun is turned on, the fluid pressures will initially be much higher than when flow is fully established. For fluid diluents that are relatively incompressible, such as liquid fluid diluents, the fluid pressures drop very quickly to the desired levels as flow begins. However, for fluid diluents that are significantly compressible, such as gases and supercritical fluids, the fluid pressures will drop much more slowly, which could adversely affect performance of some downstream applications, such as causing a poorly formed spray or excessively high spray rate until the desired spray flow rate is established.

For end uses that have intermittent flow, when compressible fluid diluents are used, such as compressed fluids, it is often desirable to shut off the diluent supply flow 400.2 to the flow restrictor means simultaneously with shutting off the flow of liquid mixture 480, and likewise to turn on the flows simultaneously. This can be done automatically several ways. One method is to mechanically or electronically synchronize the operation of the valves so that whenever the flow of liquid mixture 480 is turned on or off, an electronic or mechanical signal is actuated that causes the supply flow of fluid diluent 400.2 to be simultaneously turned on or off. Another method is to use a pressure sensor, located downstream of the flow restrictor means, to activate closing and opening of the flow valve that controls the supply flow of fluid diluent 400.2, as the downstream pressure rises and falls about a set point value in response to the flow of liquid mixture 480 being turned off and on. These and other methods are known to those skilled in the art of flow control.

The proportion of compressed fluid diluent in the liquid mixture prepared by the present invention preferably ranges from about 10 to about 95 weight percent of the total weight of the mixture. More preferably, the proportion of compressed fluid diluent in the liquid mixture ranges from about 20 to about 60 weight percent. The amount of compressed fluid diluent used generally depends upon the viscosity of the liquid concentrate and the desired viscosity of the liquid mixture for a given application. For spray applications, the viscosity of the liquid spray mixture prepared by the present invention is preferably less than about 300 centipoise. More preferably, the viscosity of the liquid spray mixture ranges from about 1 to about 150 centipoise. Most preferably, the viscosity of the liquid spray mixture ranges from about 5 to about 50 centipoise.

The compressed fluid diluent is preferably used in the present invention at temperature and pressure conditions in which the density of the compressed fluid diluent is greater than about 0.1 grams per cubic centimeter (g/cc). More preferably, the density of the compressed fluid is greater than about 0.2 g/cc.

The proportion of first flow of diluent to second flow of diluent is chosen to give the desired proportion of fluid diluent to liquid concentrate in the prepared liquid mixture, that is, the proportions are equivalent. Because the first flow of diluent and the second flow of diluent are the same material at substantially the same pressure and temperature, the volumetric proportion of the first flow to the second flow is the same as the mass proportion. However, the second flow of diluent is converted to an equal volumetric flow of liquid concentrate in the volumetric flow conversion means. But because the second flow of diluent and the liquid concentrate will generally have different densities, the mass flow of concentrate will be different from the mass flow of the second flow of diluent, but it can be readily calculated by using the respective densities for the corresponding pressure and temperature of the diluent. For example, for a liquid mixture that contains 30 weight percent diluent and 70 weight percent concentrate, if the diluent has a density of 0.5 g/cc and the concentrate has a density of 1.0 g/cc, then the liquid mixture contains 46 volume percent diluent and 54 volume percent concentrate. For spray applications, often the proportion of compressed fluid diluent is adjusted during spraying until the proper spray performance is obtained in order to determine the proper proportion.

The resulting liquid mixture can be readily sprayed by passing the mixture under pressure through an orifice to form a liquid spray of droplets, which may be deposited onto a substrate to form a coating thereon, as taught in the aforementioned related patents. This is typically done using an airless spray gun with airless spray tips that preferably have an orifice size of from about 0.004 to about 0.072 inch in diameter. More preferably, the orifice size ranges from about 0.004 to about 0.025 inch in diameter. When the compressed fluid diluent is supercritical carbon dioxide, nitrous oxide, or ethane at spraying conditions, the spray temperature typically ranges from about 30° to about 70° Celsius.

Figure 2:
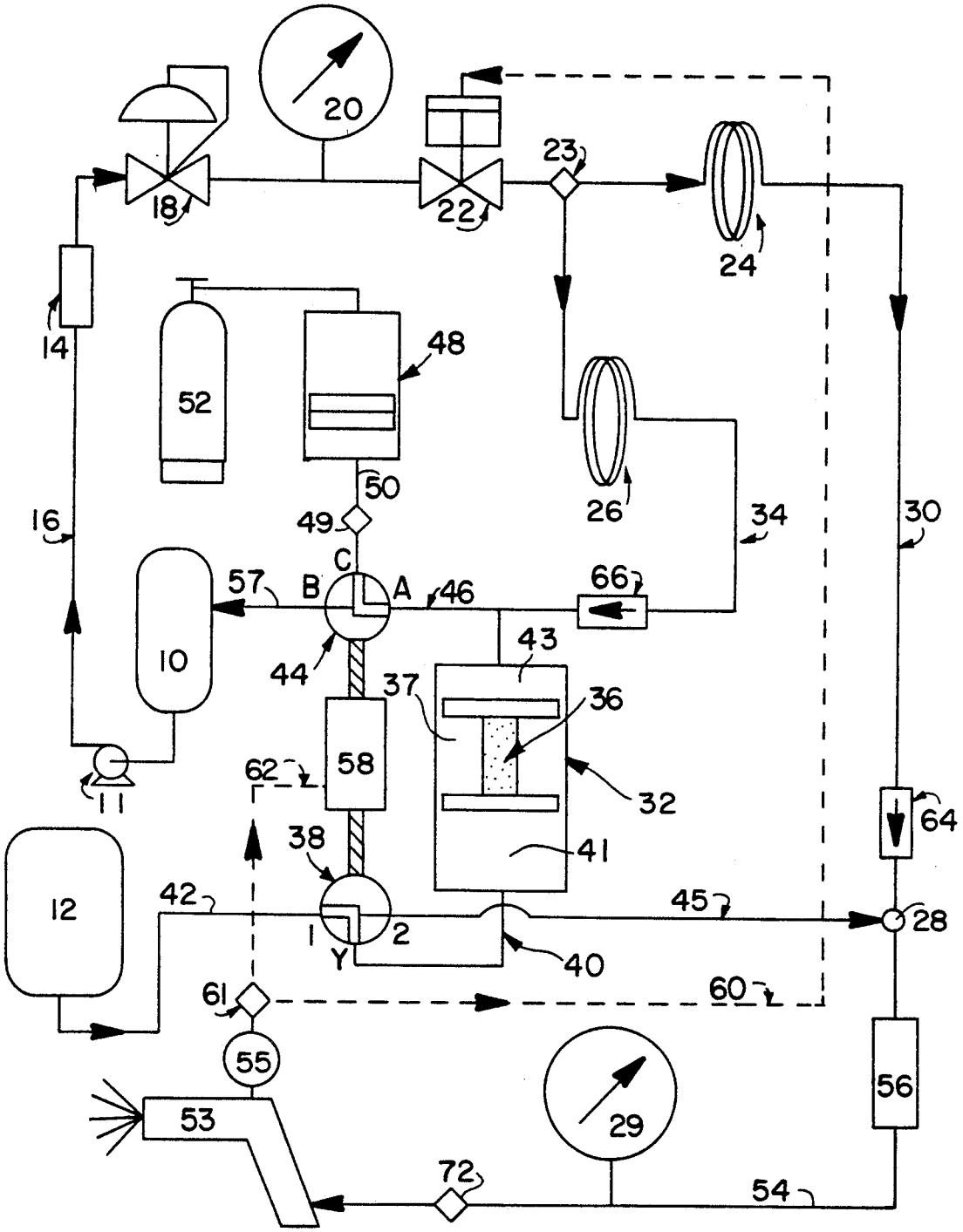
FIG. 2 is a schematic drawing of a preferred embodiment of the present invention illustrating the components of the method and apparatus suitable for spray applications.

A schematic diagram of a preferred embodiment of the present invention, which is suitable for use with intermittent or periodic spray applications, is shown in FIG. 2. The system incorporates features which allow it to readily alternate between 1) a spray mode of operation, during which liquid concentrate is supplied from the concentrate chamber, and 2) a reload mode of operation, during which no spraying occurs and the concentrate chamber is refilled with liquid concentrate.

A fluid diluent, preferably a compressed fluid such as carbon dioxide, is supplied from source 10, which may be a pressurized cylinder or tank. The liquid concentrate, preferably a coating concentrate, is supplied from source 12, which may be a pressurized tank or a tank with an air-driven piston pump (not shown) to pressurize the concentrate to feed pressure. Both diluent and concentrate are provided to the system at pressures chosen to assure proper functioning of the spray and reload modes.

Diluent from source 10 is pressurized by pump 11, such as an air driven piston pump, preferably a double-acting pump or a single-acting pump having a surge tank or accumulator to dampen pressure pulsations. The pressurized diluent is conveyed by conduit 16, filtered by optional filter 14, and then depressurized by pressure regulator 18 to the desired supply pressure as shown by pressure gauge 20. Pressure regulator 18 is used both to adjust the supply pressure, and thereby adjust the spray pressure, and to maintain a constant supply pressure. The diluent source pressure produced by pump 11 is typically set to be about 200 psi above the supply pressure 20 produced by pressure regulator 18. Automatic valve 22, which is open only during the spray mode of operation, supplies the diluent to flow splitter 23, which may be a tubing tee, and then, at substantially equal pressures and temperatures, to a first flow restrictor means 24 and a second flow restrictor means 26 connected with parallel flow. In this illustration, each flow restrictor means contains a single flow restrictor, such as a capillary tube, as shown in the drawing. The flow restrictors are dimensionally sized to deliver the desired proportion of first flow of diluent to second flow of diluent at the desired operating conditions. The-first flow of diluent flows from the first flow restrictor means 24 through conduit 30 and check valve 64 to mix point 28, which may be a tubing mixing tee. The second flow of diluent flows from the second flow restrictor means 26 through conduit 34 and check valve 66 into diluent chamber 43 in volumetric flow conversion means 32. During the spray mode of operation, three-way valve 44 is in position B-C, so no diluent flows through conduit 46.

The volumetric flow conversion means 32 is a cylinder housing that contains a freely moving piston-type partition 36, which separates diluent chamber 43 from concentrate chamber 41. The piston-type partition is a dual sealed spool-shaped piston having captive solvent lubricant in annular volume 37 between the seals to reduce friction and improve seal longevity. The captive solvent lubricant is preferably chosen to be compatible with the concentrate. During the spray mode of operation, concentrate flows from concentrate chamber 41 through conduit 40 to three-way valve 38, which is in position Y-2, and then through conduit 45 to mix point 28, where it is blended and mixed with the first flow of diluent to form the desired liquid mixture, which in the preferred embodiment is a spray mixture at the proper spray pressure. As aforementioned, the spray pressure, as indicated by pressure gauge 29, is set by pressure regulator 18, taking into account the pressure drop across the flow restrictor means. Preferably a relatively high pressure drop of about 50 to about 500 psi is established across the flow restrictor means during spraying. When the compressed fluid is carbon dioxide, the spray pressure is typically between about 1000 and 1600 psi. Conduits 40 and 45 are dimensionally sized to reduce pressure drop caused by high viscosity. Check valve 64 may be spring loaded such that the pressure drop across it that is required to open it is approximately the same as the pressure loss in the concentrate flow caused by high viscosity and frictional effects. The mixing means may include a static mixer (not shown).

For spray applications, the liquid spray mixture flows from mix point 28 through heater 56, where it is heated to the desired spray temperature. The heated spray mixture passes through insulated conduit 54 to junction 72, where spray gun 53, such as an airless spray gun, is connected to conduit 54 by suitable means, such as an insulated high pressure flexible hose. To maintain uniform spray temperature at the spray gun during intermittent spraying, a circulation pump (not shown), such as a gear pump, may be used to circulate the heated spray mixture between heater 56 and the spray gun. A filter (not shown) may also be used to filter the spray mixture before it enters the spray gun to prevent the spray orifice from plugging by particulates.

The spray mode of operation occurs when spray gun 53 is activated to spray the spray mixture. The spray gun may be activated manually by hand or automatically by a pneumatic or electrical signal from a spray controller (not shown). Sensor device 55, which may be a mechanical switch connected to a manual spray gun or a pressure switch or electrical switch connected to an automatic spray gun or spray controller, is activated at the same time the spray gun is activated. When activated, sensor device 55 sends an electrical or pneumatic signal 60, as shown by a dotted line in the drawing, from signal splitter 61 to automatic valve 22, which opens the valve and allows supply diluent to flow into the proportionation system as spraying occurs. When activated, sensor device 55 simultaneously sends an electrical or pneumatic signal 62 to reload actuator 58, which is an electrically or pneumatically driven mechanical actuator that simultaneously switches the valve positions of three-way valves 38 and 44. Some operational time lag as actuator 58 repositions from spray mode to reload mode is normally permissible. During the spray mode of operation, the signal from sensor device 55 causes reload actuator 58 to position three-way valve 38 in position Y-2 and to position three-way valve 44 in position B-C.

The reload mode of operation occurs when spray gun 53 is deactivated and spraying stops. In the reload mode, sensor device 55 closes automatic valve 22 to shut off the diluent supply and causes reload actuator 58 to position three-way valve 38 in position Y-1 and three-way valve 44 in position A-C. This allows concentrate supplied from source 12, at a supply pressure above the spray pressure, to flow through conduit 42 and valve 38 into concentrate chamber 41. When the concentrate chamber is full of concentrate, piston 43 stops moving and the pressure rises to the supply pressure of the concentrate, which causes the supply pump to stall. As concentrate flows into concentrate chamber 41, diluent flows from diluent chamber 43 through conduit 46, valve 44, connection 49, and conduit 50 into accumulator 48. Accumulator 48 is of a design familiar to those skilled in the art and consists of a sealed piston in a cylinder. One chamber is filled with diluent and the opposite chamber is filled with pressurized gas, such as nitrogen. The accumulator gas volume may be increased by using an external tank or cylinder, such as nitrogen cylinder 52, filled to the desired pressure. The gas pressure in accumulator 48 and cylinder 52 must exceed the diluent supply pressure at source 10 and is preferably set to the nominal spray pressure. A relatively large gas volume maintains a substantially constant pressure in the accumulator during filling with diluent. This prevents wide pressure fluctuations in the volumetric flow conversion means 32 when shifting between spray and reload modes. Preferably the diluent capacity of accumulator 48 exceeds the capacity of diluent chamber 43. During the spray mode of operation, valve 44 is in position B-C, which allows diluent to flow from accumulator 48 through conduit 57 to diluent source 10.

Alternatively, instead of using accumulator 48 and cylinder 52, during the reload mode of operation, diluent may be passed from diluent chamber 43 to diluent source 10, while maintaining relatively constant pressure in diluent chamber 43, by replacing valve 44 with a suitable two-way valve and a pressure regulator or pressure reduction valve.

During operation in the spray mode, supply diluent from valve 22 flows through the flow restrictor means 24 and 26, thus producing the first flow of diluent and the second flow of diluent having the desired proportioned flow rates. The second flow of diluent enters the diluent chamber 43 and thereby produces a substantially equal flow of concentrate from concentrate chamber 41, which is mixed at substantially equal pressures with the first flow of diluent at mix point 28, thereby producing the desired proportioned flow of liquid spray mixture. Because the flow restrictors operate with the same fluid and with essentially the same differential pressures, the relative flow rate proportion established between them is essentially constant irrespective of variations in concentrate characteristics, spray temperature, and spray pressure.

During operation in the reload mode, the diluent supply is shut off, so the system pressure remains nominally at the spray pressure. Concentrate flows under higher pressure from source 12 into concentrate chamber 41 and thereby expels diluent from diluent chamber 43 into accumulator 48. When the spray mode is resumed, diluent is expelled from accumulator 48 to source 10 for reuse.

This embodiment illustrates that valve synchronization or sequencing may be integral to the effective delivery of a constant proportion of liquid concentrate and fluid diluent. The three-way valves 38 and 44 and the automatic valve 22 can each operate independently, but in this preferred embodiment they operate in unison by way of a single actuator, namely the sensor device 55 that is triggered by operation of the spray gun. Other methods of actuation may also be used, such as a pressure switch that responds to changes in spray mixture pressure. The pressure switch would actuate the spray mode when the spray pressure drops below a set point pressure that is incrementally higher than the spray pressure, in response to activation of the spray gun. The pressure switch would actuate the reload mode when the spray pressure rises above the set point pressure in response to deactivation of the spray gun. Other actuators and other sequencing of valve operation may also be used if desired.

This invention will typically accommodate a 2 to 1 range in flow rate from the spray gun, such as from changing the size of the spray orifice, without requiring the flow restrictors to be resized. This will typically be accompanied by a nominal 4 to 1 change in differential pressure across the flow restrictors, under conditions in which turbulent flow exists through the restrictors. A change in the flow rate might require adjustment of the diluent supply pressure to maintain the same spray pressure.

Figure 4:
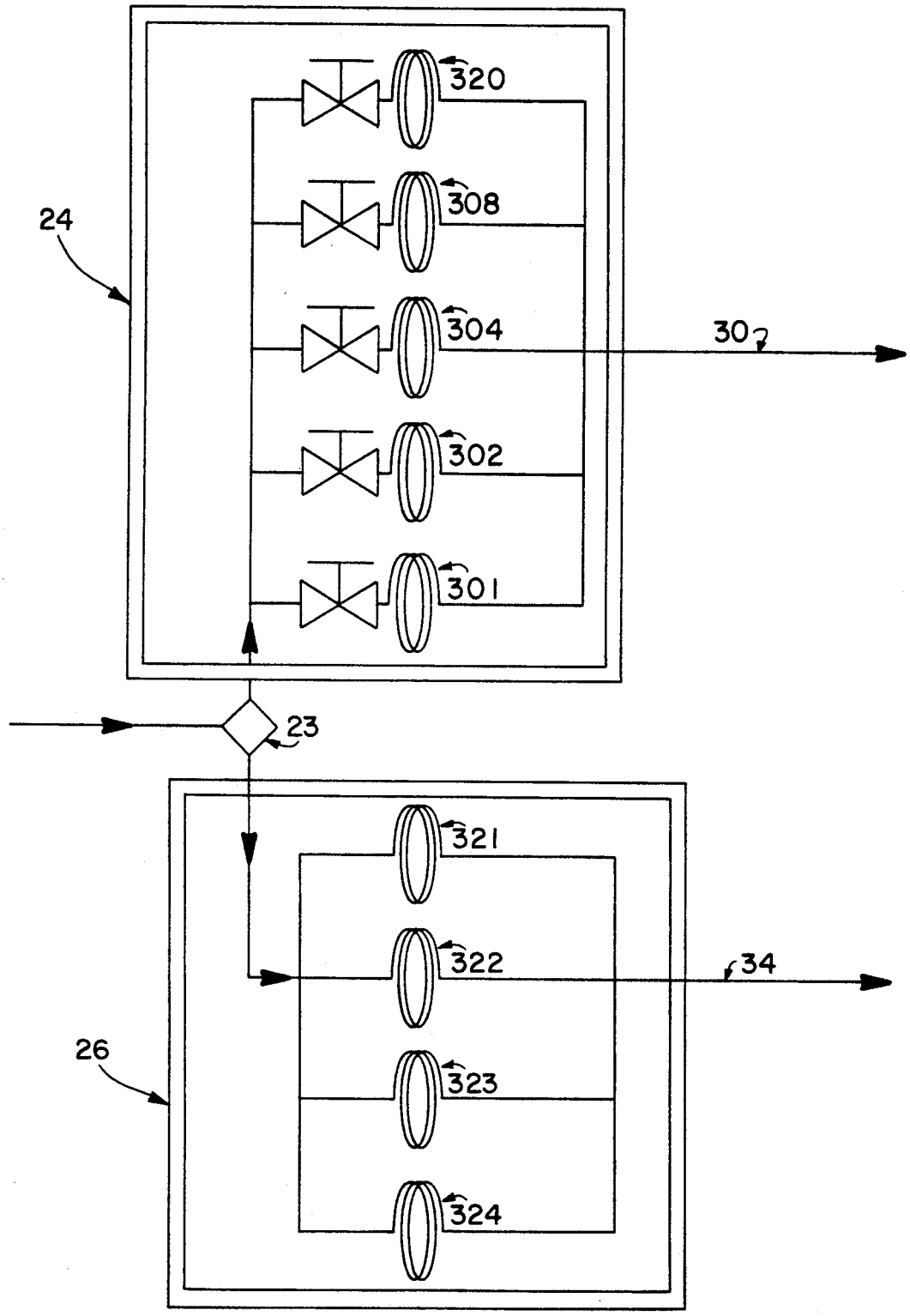
FIG. 4 is a more detailed schematic drawing illustrating flow restrictor means having several flow restrictors.

The flow restrictor means may consist of a single flow restrictor or a network of two or more flow restrictors. By changing the flow path of diluent through the network, that is, by valving off some flow restrictors and valving open others, the overall flow resistance levels of the first and second flow restrictor means can be incrementally changed, and therefore the flow rate proportion can be adjusted stepwise without resizing the flow restrictors. The pressure differential can also be adjusted at constant flow rate proportion. This is illustrated in FIG. 4, which shows the flow restrictor means 24 and 26 of FIG. 2 expanded as networks of several flow restrictors in parallel. Each of the flow restrictors in network 24 has a two position valve, which in the off position will block flow and in the on position will permit flow through the restrictor. These valves may be manipulated manually or automatically to attain step adjustments in the proportion of first flow of diluent through conduit 30 to second flow of diluent through conduit 34, thereby incrementally adjusting the composition of the liquid spray mixture. The flow restrictors in network 26 may also have valves if desired.

For example, restrictors 321, 322, 323, and 324 of network 26 and restrictor 320 of network 24 may each be capillary tubing two feet in length with a 0.020-inch bore. These five restrictors are sized to carry a major portion of the diluent flow through each network and-are preferably, but not necessarily, identical. This sizing technique is advantageous to avoid the somewhat differing flow characteristics of individual restrictors. In this example, these five restrictors are each arbitrarily assigned a flow rate value of 20. The remaining capillary tubing restrictors are sized as follows: restrictor 301 has a length of 0.5 feet, a bore of 0.005 inch, and a flow rate of 1; restrictor 302 has a length of 0.125 feet, a bore of 0.005 inch, and a flow rate of 2; restrictor 304 has a length of 1.25 feet, a bore of 0.010 inch, and a flow rate of 4; restrictor 308 has a length of 11.6 feet, a bore of 0.020 inch, and a flow rate of 8 compared to the others. By manipulating the valves of network 24, one may obtain incremental steps in total relative flow rate from 20 through 35 inclusively. The flow rate proportions between networks 24 and 26 can correspondingly be stepped from 20/80 through 35/80 inclusively. Therefore, this illustrates that the present invention may be implemented with an adjustable proportion which may be controlled by the variety of methods known to those skilled in the art of process control.

Although the above explanations are for a proportioning system consisting a fluid diluent and a single liquid concentrate, the present invention is readily expanded on the same principles to encompass additional liquid concentrates, all in fixed proportions to each other. This is useful for such spray applications as 1) spraying a coating material that has two reactive component concentrates that are too highly reactive to be premixed before spraying, 2) spraying a material with addition of a catalyst to initiate reaction, 3) color blending applications, and the like.

Figure 3:
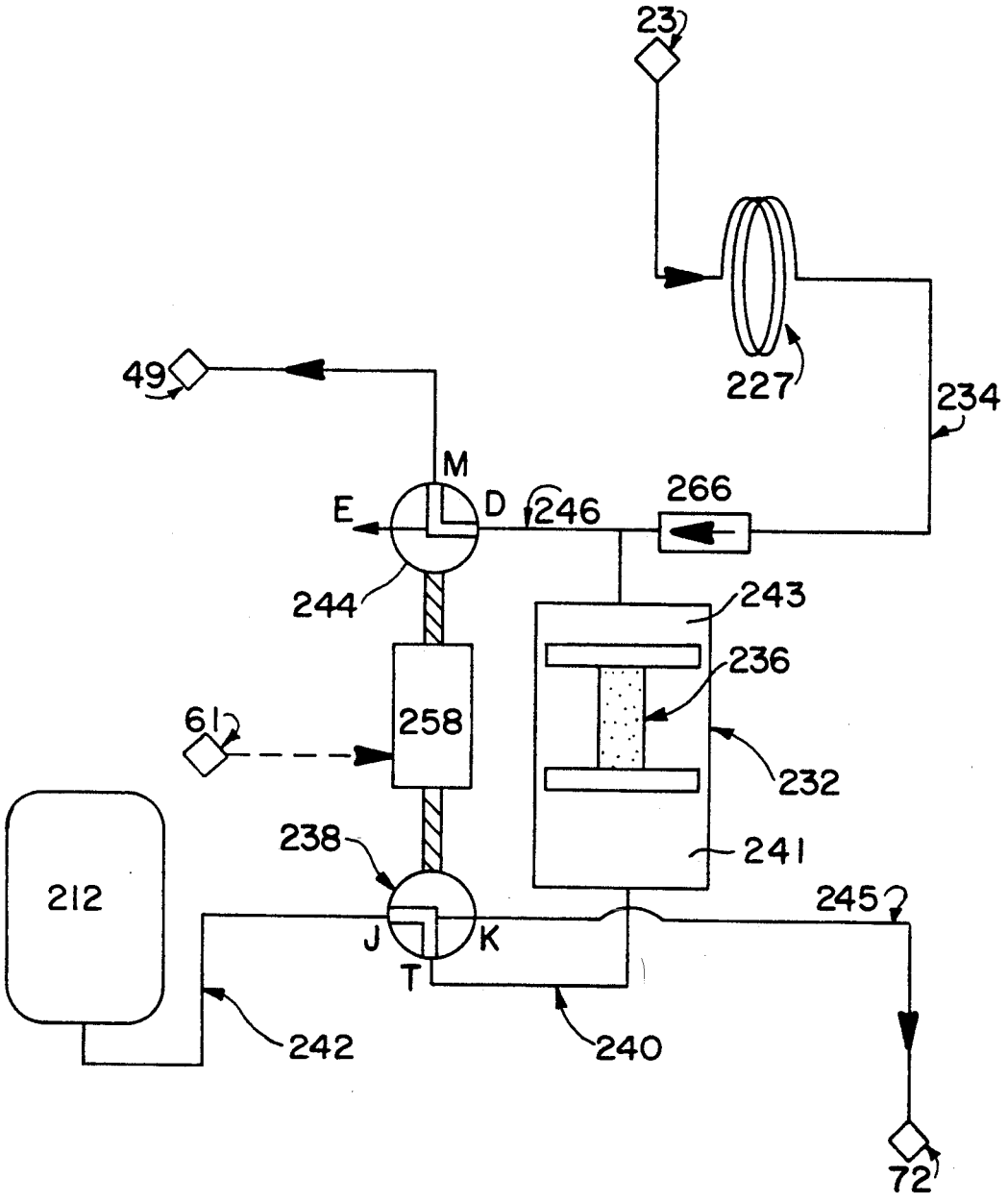
FIG. 3 is a schematic drawing showing components added to the system of FIG. 2 when a second liquid concentrate is employed.

The aforementioned proportioning system shown in FIG. 2 may be expanded to include proportionation of a second liquid concentrate along with the first liquid concentrate by using the additional components illustrated in FIG. 3. The following junction points are common to both FIGS. 2 and 3 and serve as branch points for the additional components: diluent flow splitter 23, connection 49, signal splitter 61, and junction point 72. Referring now to FIG. 3, during the spray mode of operation, diluent flows from flow splitter 23 through flow restrictor means 227, which has been dimensionally sized to give the proper proportions, conduit 234, and check valve 266, to diluent chamber 243 in volumetric flow conversion means 232, which is analogous to volumetric flow conversion means 32 in FIG. 2. Three-way valve 244 is in position E-M to prevent flow of diluent through conduit 246. Displacement of the piston-type partition 236 causes the second concentrate to flow from concentrate chamber 241 through conduit 240, three-way valve 238, which is in position K-T, and conduit 245 to junction point 72, where the second concentrate is mixed with the mixture of the first concentrate and diluent from mix point 28 in FIG. 2. Adding the second concentrate to form the final liquid mixture at junction 72 is advantageous for very reactive systems. For less reactive systems, the second concentrate may be added at mix point 28 or any point downstream.

Actuator 258 is analogous to actuator 58 in FIG. 2; it is activated by a signal from sensor device 55 in FIG. 2 through signal splitter 61. During the spray mode of operation, actuator 258 positions valve 238 in position K-T and valve 244 in position E-M, where no-flow occurs through port E. When the spray gun is deactivated and the reload mode of operation is begun, actuator 258 positions valve 238 in position J-T and valve 244 in position M-D. This allows the second concentrate to flow from source 212, which is analogous to source 12 in FIG. 2, through conduit 242, valve 238, and conduit 240 to concentrate chamber 241. This displaces partition 236 and expels diluent from diluent chamber 243 through conduit 246 and valve 244 to junction point 49, and hence into accumulator 48 in FIG. 2.

System expansions to encompass the proportionation of yet additional concentrates will be substantially equivalent to replication of FIG. 3 for each additional concentrate.

While preferred forms of the present invention have been described, it should be apparent to those skilled in the art that methods and apparatus may be employed that are different from those shown without departing from the spirit and scope thereof.

What is claimed is:

1. A method for forming a liquid mixture of liquid concentrate and fluid diluent in a fixed proportion, which comprises:

(a) providing a first flow of diluent with flow rate $F_D$ and a second flow of diluent with flow rate $F_C$, by supplying diluent at substantially equal and constant pressures and temperatures to a first flow restrictor means and a second flow restrictor means in parallel, each flow restrictor means containing a network of two or more flow restrictors and having the flow restrictors dimensionally sized and configured to produce, in combination, a fixed flow rate proportion of first flow of diluent to second flow of diluent of $F_D/F_C$, for substantially equal pressure drops across the flow restrictor means;

(b) volumetrically converting said second flow of diluent from said second flow resistor means into a flow of concentrate having substantially the same flow rate and substantially the same pressure, by using a volumetric flow conversion means comprising a housing having a diluent chamber and a concentrate chamber separated by a freely moving partition and being configured such that flow of said second flow of diluent into the diluent chamber simultaneously and volumetrically displaces the partition and thereby causes concentrate to flow from the concentrate chamber at a flow rate substantially the same as flow rate $F_C$, the concentrate chamber being filled with concentrate prior to proportionation; and (c) mixing said flow of concentrate from said concentrate chamber and said first flow of diluent from said first flow restrictor means at substantially the same pressures to form a liquid mixture.

2. The method of claim 1 wherein said fluid diluent comprises a compressed fluid.

3. The method of claim 2 wherein said compressed fluid is selected from the group consisting of carbon dioxide, nitrous oxide, ethane, and mixtures thereof.

4. The method of claim 2 wherein said liquid concentrate is a coating concentrate having a viscosity less than about 5000 centipoise and containing at least one component capable of forming a coating on a substrate.

5. The method of claim 4 wherein said at least one component capable of forming a coating on a substrate is a polymer component.

6. The method of claim 4 further comprising forming a third flow of diluent by passing diluent through a third flow restrictor means, flowing the third flow of diluent into a diluent chamber in a second volumetric flow conversion means to produce a flow of a second concentrate from a concentrate chamber, and mixing the flow of second concentrate with the first flow of diluent and the flow of concentrate produced by the second flow of diluent.

7. The method of claim 4 further comprising spraying said liquid mixture under pressure through an orifice in a spray gun to form a liquid spray of droplets.

8. The method of claim 7 wherein the liquid mixture is sprayed at a temperature and pressure at which the compressed fluid is a supercritical fluid.

9. The method of claim 7 wherein the flow of supplied diluent is simultaneously and automatically shut off when said spray gun is deactivated to stop spraying and turned on when said spray gun is activated to start spraying.

10. The method of claim 7 wherein said concentrate chamber is automatically refilled with liquid concentrate when said spray gun is deactivated and no spraying occurs.

11. The method of claim 10 wherein diluent expelled from said diluent chamber, as said concentrate chamber is refilled with concentrate, is recycled to the provided diluent for reuse.

12. An apparatus for forming a liquid mixture of liquid concentrate and fluid diluent in fixed proportion comprising, in combination:

(a) means for forming a first flow of diluent with flow rate $F_D$ and a second flow of diluent with flow rate $F_C$, which comprises a first flow restrictor means and a second low restrictor means operating in parallel, each flow restrictor means containing, a network of two or more one flow restrictors and having the flow restrictors dimensionally sized and configured to produce, in combination, a fixed flow rate proportion of first flow of diluent to second flow of diluent of $F_D/F_C$, for substantially equal pressure drops across the flow restrictor means;

(b) means for supplying diluent at substantially equal and constant pressures and temperatures to said first and second flow restrictor means;

(c) means for volumetrically converting said second flow of diluent from said second flow resistor means into a flow of concentrate having substantially the same flow rate and substantially the same pressure, which comprises a housing having a diluent chamber and a concentrate chamber separated by a freely moving partition and being configured such that flow of said second flow of diluent into the diluent chamber simultaneously and volumetrically displaces the partition and thereby causes concentrate to flow from the concentrate chamber at a flow rate substantially the same as flow rate $F_C$;

(d) means for filling said concentrate chamber with concentrate prior to proportionation; and (e) means for mixing said flow of concentrate from said concentrate chamber and said first flow of diluent from said first flow restrictor means at substantially the same pressures to form a liquid mixture.

13. The apparatus of claim 12 further comprising means for heating said liquid mixture and a spray gun for spraying said heat liquid mixture.

14. The apparatus of claim 13 further comprising means for simultaneously and automatically shutting off the flow of supplied diluent when said spray gun is deactivated to stop spraying and turning on the flow of supplied diluent when said spray gun is activated to start spraying.

15. The apparatus of claim 13 further comprising means for valving on and off the flow of diluent through individual flow restrictors.

16. The apparatus of claim 13 further comprising means for automatically refilling said concentrate chamber with liquid concentrate when said spray gun is deactivated and no spraying occurs.

17. The apparatus of claim 16 further comprising means for recycling diluent expelled from said diluent chamber, as said concentrate chamber is refilled with concentrate, to the means for supplying diluent.

* * * * *